US010260305B2

(12) United States Patent
Pathak et al.

(10) Patent No.: US 10,260,305 B2
(45) Date of Patent: Apr. 16, 2019

(54) COMPLETION SYSTEM WITH EXTERNAL GATE VALVE

(71) Applicant: Onesubsea IP UK Limited, London (GB)

(72) Inventors: Parth Dilip Pathak, Houston, TX (US); Vairaraghavan Rajalingam Ganesan, Coimbatore (IN); Karthikeyan Pushparaj, Coimbatore (IN)

(73) Assignee: ONESUBSEA IP UK LIMITED, London (GB)

( * ) Notice: Subject to any disclaimer, the term of this patent is extended or adjusted under 35 U.S.C. 154(b) by 279 days.

(21) Appl. No.: 14/878,074

(22) Filed: Oct. 8, 2015

(65) Prior Publication Data

US 2017/0101842 A1 Apr. 13, 2017

(51) Int. Cl.
*E21B 33/068* (2006.01)
*E21B 34/02* (2006.01)

(52) U.S. Cl.
CPC ..... *E21B 33/068* (2013.01); *E21B 34/02* (2013.01)

(58) Field of Classification Search
CPC ..... E21B 33/068; E21B 33/04; E21B 34/02; F16L 29/007
See application file for complete search history.

(56) References Cited

U.S. PATENT DOCUMENTS

| | | | | |
|---|---|---|---|---|
| 3,043,371 | A | 7/1962 | Rector | |
| 3,321,176 | A * | 5/1967 | Bolling, Jr. | F16K 3/207 251/172 |
| 5,415,378 | A * | 5/1995 | Craven | E21B 34/02 251/31 |
| 6,345,668 | B1 | 2/2002 | Reilly | |
| 7,275,591 | B2 | 10/2007 | Allen et al. | |
| 2003/0015681 | A1* | 1/2003 | Chatufale | F16K 3/207 251/329 |
| 2007/0169940 | A1* | 7/2007 | Fenton | E21B 33/035 166/368 |
| 2011/0108275 | A1* | 5/2011 | Borak | E21B 33/037 166/308.1 |

FOREIGN PATENT DOCUMENTS

| | | |
|---|---|---|
| EP | 1136649 | 9/2001 |
| EP | 1278934 | 8/2005 |
| WO | 2001073256 | 10/2001 |
| WO | 2014081310 | 5/2014 |

* cited by examiner

*Primary Examiner* — Carib A Oquendo
(74) *Attorney, Agent, or Firm* — Eubanks PLLC

(57) ABSTRACT

A gate valve assembly for use with a tubing hanger with a vertical bore, the gate valve including a housing located externally to the tubing hanger and a gate at least partially locatable in the housing and configured to extend through the tubing hanger and into the tubing hanger vertical bore. The gate valve assembly also includes a seat assembly having a seat and located within the tubing hanger, the seat assembly configured to seal against the gate when the gate is extended into the tubing hanger vertical bore.

22 Claims, 5 Drawing Sheets

COMPLETION SYSTEM WITH EXTERNAL GATE VALVE

BACKGROUND

This section is intended to introduce the reader to various aspects of art that may be related to various aspects of the presently described embodiments. This discussion is believed to be helpful in providing the reader with background information to facilitate a better understanding of the various aspects of the described embodiments. Accordingly, it should be understood that these statements are to be read in this light and not as admissions of prior art.

In the oil and gas industry, a well may be drilled and a completion system may be installed at a surface end of the well in order to extract oil, natural gas, and/or other subterranean resources from the earth, for example. These systems may be located onshore or offshore depending on the location of the well. Further, such systems generally include a wellhead assembly through which a resource is extracted or fluids may be injected. These wellhead assemblies may include a wide variety of components, such as various housings, trees, casings, hangers, valves, fluid conduits, and the like, that control drilling and/or extraction operations. For example, after well completion, a device typically referred to as a tree, such as a horizontal, vertical, hybrid, and/or modular tree, can be installed above the wellhead. Vertical, horizontal, and hybrid, and/or modular trees each may include a number of valves and other equipment to control production or injection and perform other oilfield operations, as well as to provide pressure barriers for subsea systems.

A tubing hanger may be installed in a completion system to support production tubing through which production fluids may be produced, injection tubing through which fluids may be injected, or other pipe or "tubing string" through which fluids may flow. The tubing hanger may be installed in or at the top of the wellhead assembly, within a casing hanger, or landed within a tubing spool, adapter spool, or production or injection tree, for example. The tubing string may include an internal fluid passageway or bore, for example a production bore that extends into the production zone of the well to produce hydrocarbons from the well.

BRIEF DESCRIPTION OF THE DRAWINGS

For a detailed description of embodiments of the present disclosure, reference will now be made to the accompanying drawings in which.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments of the present disclosure and claims, the articles "a," "an," "the," and "said" are intended to mean that there are one or more of the elements. The terms "comprising," "including," and "having" are used in an open-ended fashion, and thus should be interpreted to mean "including, but not limited to . . . ." Also, any use of any form of the terms "connect," "engage," "couple," "attach," "mate," "mount," or any other term describing an interaction between elements is intended to mean either an indirect or a direct interaction between the elements described. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. The use of "top," "bottom," "above," "below," "upper," "lower," "up," "down," "vertical," "horizontal," and variations of these terms is made for convenience, but does not require any particular orientation of the components.

Certain terms are used throughout the description and claims to refer to particular features or components. As one skilled in the art will appreciate, different persons may refer to the same feature or component by different names. This document does not intend to distinguish between components or features that differ in name but not function, unless specifically stated.

Figure 1A:
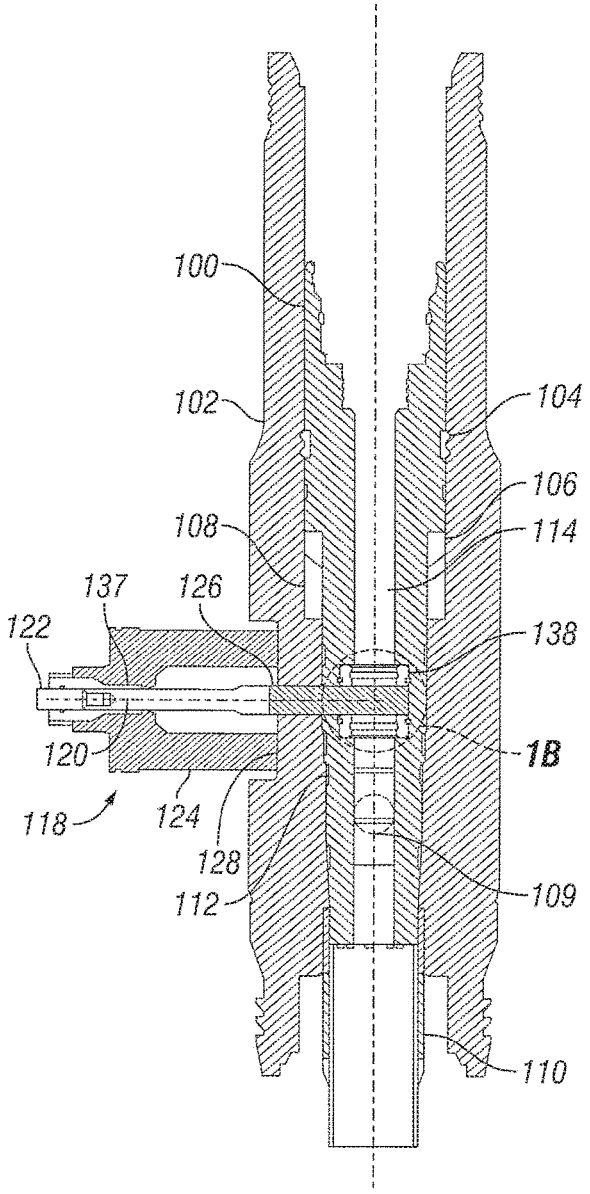
FIG. 1A depict cross-sectional view of an external gate valve in a tubing hanger in a tubing spool assembly in accordance with one or more embodiments of the present disclosure.
Figure 1B:
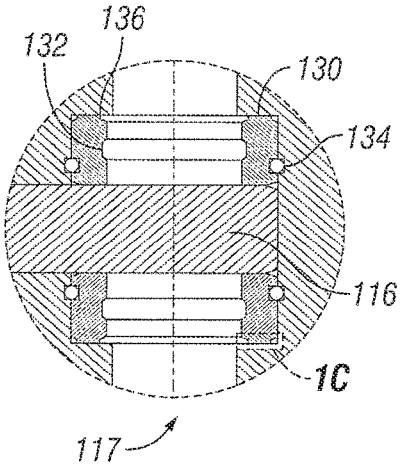
FIG. 1B depicts a magnified view of section 1B of FIG. 1A.
Figure 1C:
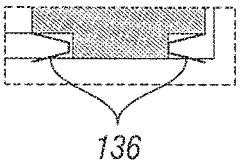
FIG. 1C depicts a magnified view if section 1C of FIG. 1B.

Referring now to FIGS. 1A-4, cross-sectional views of an assembly including an external gate valve in accordance with one or more embodiments of the present disclosure are shown. In FIG. 1A, a tubing hanger 100 is shown located within a tubing spool 102. Those having ordinary skill in the art would appreciate that although the tubing hanger 100 is shown located within a tubing spool, the tubing hanger 100 may be located or landed within one or more completion system components that may include without limitation a tubing spool, a vertical tree, a horizontal tree, a hybrid tree, and/or a modular tree, a high pressure wellhead housing, a casing hanger, an adapter spool, or any other device in association with which a pipe may be hung.

When landing the tubing hanger 100 within the tubing spool 102, the tubing hanger may be locked into the spool by a locking mechanism 104. In one or more embodiments, the tubing hanger 100 has a landing ring 106, the tubing spool 102 has a landing shoulder 108, and once the tubing hanger landing ring 106 is landed on the spool landing shoulder 108, the locking mechanism 104 may be mechanically, hydraulically, or electronically activated to lock the tubing hanger 100 into the tubing spool 102. Seals 112 (such as elastomeric or metal seals, for example) may be located around the tubing hanger 100 and may engage with the tubing spool 102 to prevent fluid leakage between the tubing hanger 100 and the tubing spool 102. As will be appreciated, the tubing hanger 100 may be coupled to, connected to, or otherwise attached to a tubing string (not shown) and may be run into place using a running tool (342, in FIG. 7). Further, in order to properly orient and/or align the tubing hanger 100 (or other equipment such as a gate valve, as will be described below) with the tubing spool 102, an orientation device 110, such as an orientation helix, may be used. Other orientation devices and methods, such as key type orientation, may also be used. In some systems, an orientation device may not even be needed.

Figure 2:
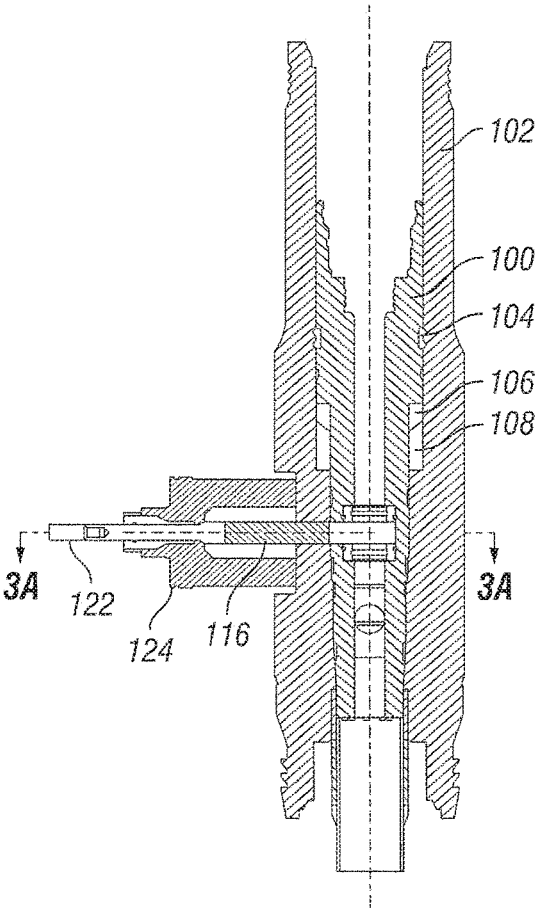
FIG. 2 depicts a cross-sectional view of an external gate valve in a tubing hanger in a tubing spool assembly in accordance with one or more embodiments of the present disclosure.
Figure 4:
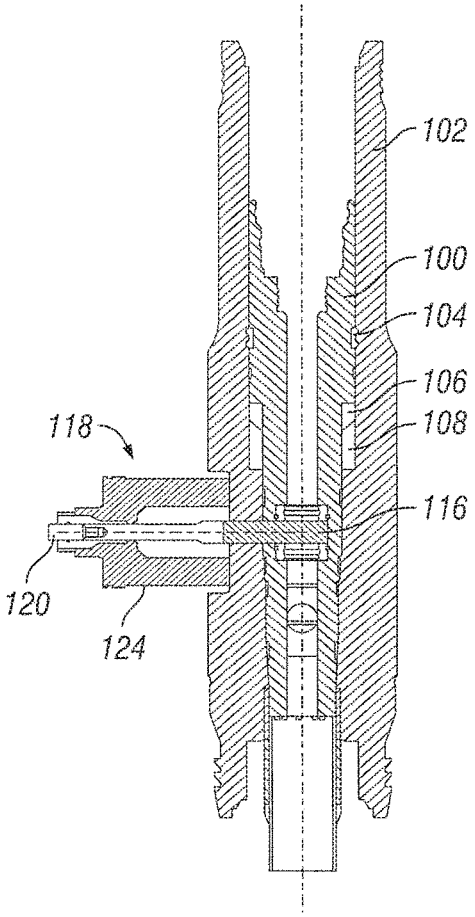
FIG. 4 depicts the external gate valve of FIG 2 in an extended position.
Figure 3A:
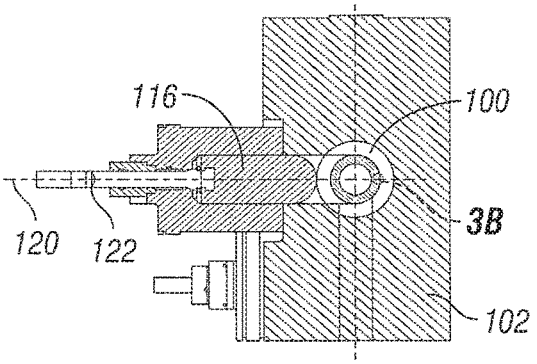
FIG. 3A depicts a cross-sectional view of the external gate valve of FIG. 2 along line 3A-3A.
Figure 3B:
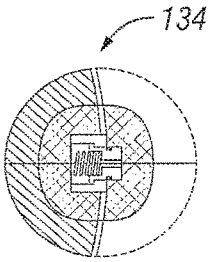
FIG. 3B depicts a magnified view of section 3B of FIG. 3A.

As shown in FIGS. 1A and 2, a vertical bore 114 of the tubing hanger 100 may include a side outlet 109 through which fluids such as production fluids may flow. External to the tubing hanger 100 is a gate valve assembly 118 mounted to the outside of the tubing spool 102. The gate valve assembly 118 includes a housing such as a bonnet 124, for housing at least partially a protrusion or gate 116 attached to an actuator rod 122, and a sealing assembly 137.

The bonnet 124 may be connected or joined, by bolted flanged connection for example, to an outer portion of tubing spool body 102 and externally from the tubing hanger 100. The bonnet 124 may be sealed against tubing spool 102 using a gasket 128 or any other sealing device known in the art.

The gate 116 may be configured to move between an open and a closed position. In the open position shown in FIG. 2, the gate 116 is retracted, at least partially, into the bonnet 124. The gate 116 may extend partially into the vertical bore 114 of the tubing hanger 100 but in some embodiments, the gate 116 may not extend into the vertical bore 114 of the tubing hanger 100. In the closed position shown in FIG. 4, the gate 116 is extended fully into the vertical bore 114 to engage with one or more seats 130 located within a cavity 138 of the tubing hanger 100 in order to prevent, restrict, or otherwise cease flow through the vertical bore 114. Although the gate 116 as shown is not sized to fit entirely within the vertical bore 114 or entirely within the bonnet 124, those having ordinary skill in the art would appreciate that the gate 116 may be configured to move in any position along the axis 120 and/or to be greater or lesser in relative length or other dimension.

In one or more embodiments, and as shown in FIG. 1A, the vertical bore 114 of the tubing hanger 100 includes a cavity 138 for installing a seat assembly 117 that may include one or more seats 130, each with a groove 132, a poppet 134, and a seat seal 136. As shown, the seats 130 are disposed within the cavity 138 and held into place using poppets 134. The grooves 132 are configured to be engaged by a tool for handling to assemble the seat assembly 117.

The poppets 134 may include a biasing mechanism (as shown in FIG. 2), such as a spring for example, used to hold the seats 130 in place (e.g., when the gate 116 is retracted from the vertical bore 114). The poppets 134 also allow for minor vertical fluctuations, for example to accommodate and/or overcome slight misalignments, clearances, or vibrational or other issues during operation.

The seat seals 136 may include pressure energized seals that may be expanded when a pressure is applied. Pressure may be applied using one or more conduits or other flowpaths (not shown) to energize and/or expand seat seals 136. Expansion of the seat seals 136 allows for proper sealing (e.g., metal-to-metal sealing) between the gate 116 and the seats 130 as well as between the seats 130 and the tubing hanger 100. The geometry and stiffness of the seat seals 136 may be determined based on initial contact pressure to initiate sealing in order to account for vertical misalignments and clearances in the gate 116, seats 130, and tubing hanger 100.

The actuator rod 122 may be a single actuating rod or may include a number of components coupled to one another to form the actuator rod 122. A stem 126 of the actuator rod 122 may be coupled to the gate 116 using a connection device or technique known in the art. For example, a T-slot connection may be used in some embodiments in order to accommodate or allow for relative vertical movement of the tubing hanger 100 and the tubing spool 102 or other completion system component(s). In particular, such a connection may allow for vertical movement and may be configured to ensure parallel sealing faces without unnecessarily stressing the stem 126 connection.

The actuator rod 122 may be activated mechanically, hydraulically, or electrically to actuate the gate 116 between the open position and a closed position. As such, the actuator rod 122 and thus, the gate valve 118, may be operated from a remote location such as from a rig, vessel, or offsite location when the gate valve 118 is operating in a subsea environment or from an offsite location if the gate valve 118 is operating in a land-based oilfield.

In one or more embodiments, the gate 116 may be configured to actuate along an axis 120 using the actuator rod 122. For example, as shown in FIG. 2, the gate 116 may be actuated by the actuator rod 122 to extend through the tubing spool 102 and tubing hanger 100, or any other components, and into the vertical bore 114. Once the gate 116 extends into and closes the vertical bore 114 in the closed position, the seat assembly 117 seals the gate 116 and the tubing hanger 100 in order to act as a pressure barrier in the vertical bore 114. Those having ordinary skill in the art would appreciate that once extended, the gate 116 may also be actuated to retract back from the vertical bore 114 through the tubing hanger 100 and tubing spool 102 into the open position, as shown in FIG. 2.

In one or more embodiments, the gate 116 may be actuated to fully extend through the vertical bore 114 of the tubing hanger 100 to close off vertical bore 114 and prevent flow of fluids through the vertical bore 114. In some embodiments, the gate 116 may remain extended in the vertical bore 114 when used as a pressure barrier, for example, in a horizontal tree. The gate 116 may also act as a primary, secondary, or intermediary valve to control flow through at least a portion of the vertical bore 114 during production or other operations. When well intervention or workover operations are to be performed, for example, the gate valve 118 may be actuated to retract the gate 116 from the vertical bore 114 to allow access to the vertical bore 114.

Figure 5:
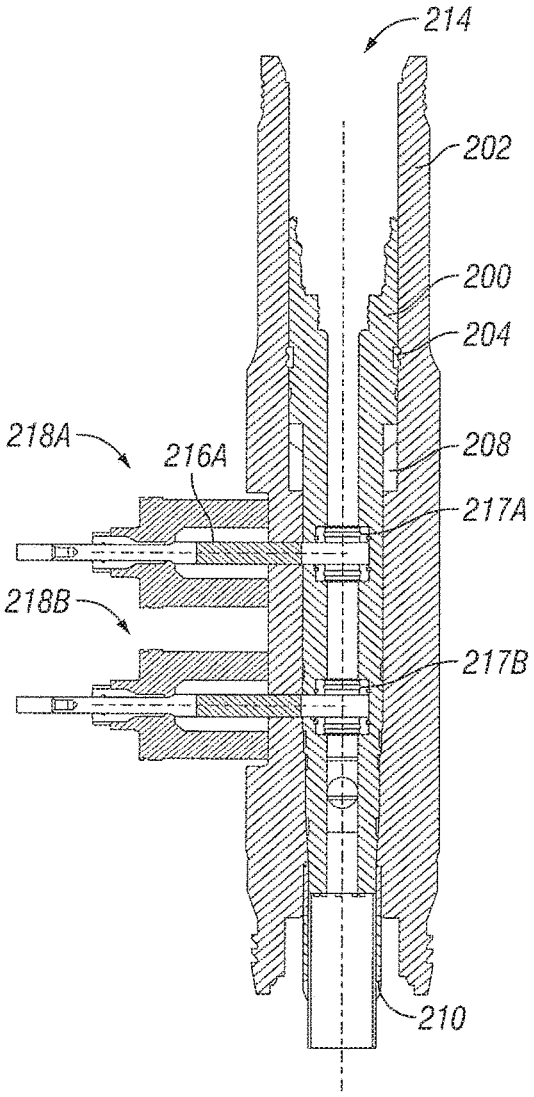
FIG. 5 depicts a cross-sectional view of an externally mounted gate valve in accordance with one or more embodiments of the present disclosure.
Figure 6:
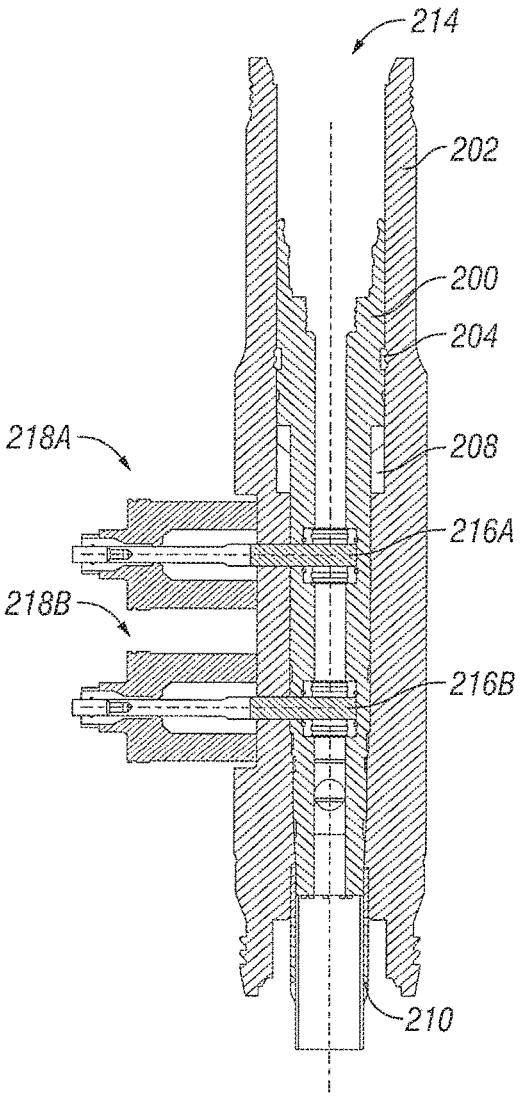
FIG. 6 depicts the externally mounted gate valve of FIG. 5 in an extended position.

Referring now to FIGS. 5 and 6, in one or more embodiments, multiple gate valves may be used in accordance with one or more embodiments of the present disclosure. Similar to FIGS. 1A-4, a tubing hanger 200 is located within a tubing spool 202 on a spool landing shoulder 208 and locked into the tubing spool 202 using a locking mechanism 204. In one or more embodiments, the locking mechanism 204 may be mechanically, hydraulically, or electronically activated to lock the tubing hanger 200 in the tubing spool 202. As will be appreciated, the tubing hanger 200 may be coupled to, connected to, or otherwise attached to a tubing string (as shown in FIG. 5) and may be run into place using a running tool (not shown). Further, in order to properly orient and/or align the tubing hanger 200 (or other equipment) with the tubing spool 202, an orientation device 210, such as an orientation helix, may be used. Other orientation devices and methods, such as key type orientation, may also be used. In some systems, an orientation device may not even be needed.

As shown in FIGS. 5 and 6, a vertical bore 214 of the tubing hanger 200 may house multiple gates 216A and 216B as well as corresponding seat assemblies 217A, 217B of gate valves 218A and 218B. While two gate valves are depicted in FIGS. 5 and 6, it should be understood that any number of multiple gate valves may be used. The gate valves 218A, 218B may be positioned anywhere along the length of the tubing hanger 200 and may be actuated independently of each other between open and closed positions in order to allow flow through or close or seal off portions of the vertical bore 214. Using multiple gate valves 218A, 218B allows for multiple pressure barriers when the gate valves are actuated and also allows for more control of flow in the vertical bore 214. Multiple gate valves may be utilized when dual barriers are needed (e.g., in the absence of a tree cap), for example. If multiple gate valves are used, a pressure containing tree cap can be eliminated and replaced by a non-pressure containing cap.

Figure 7:
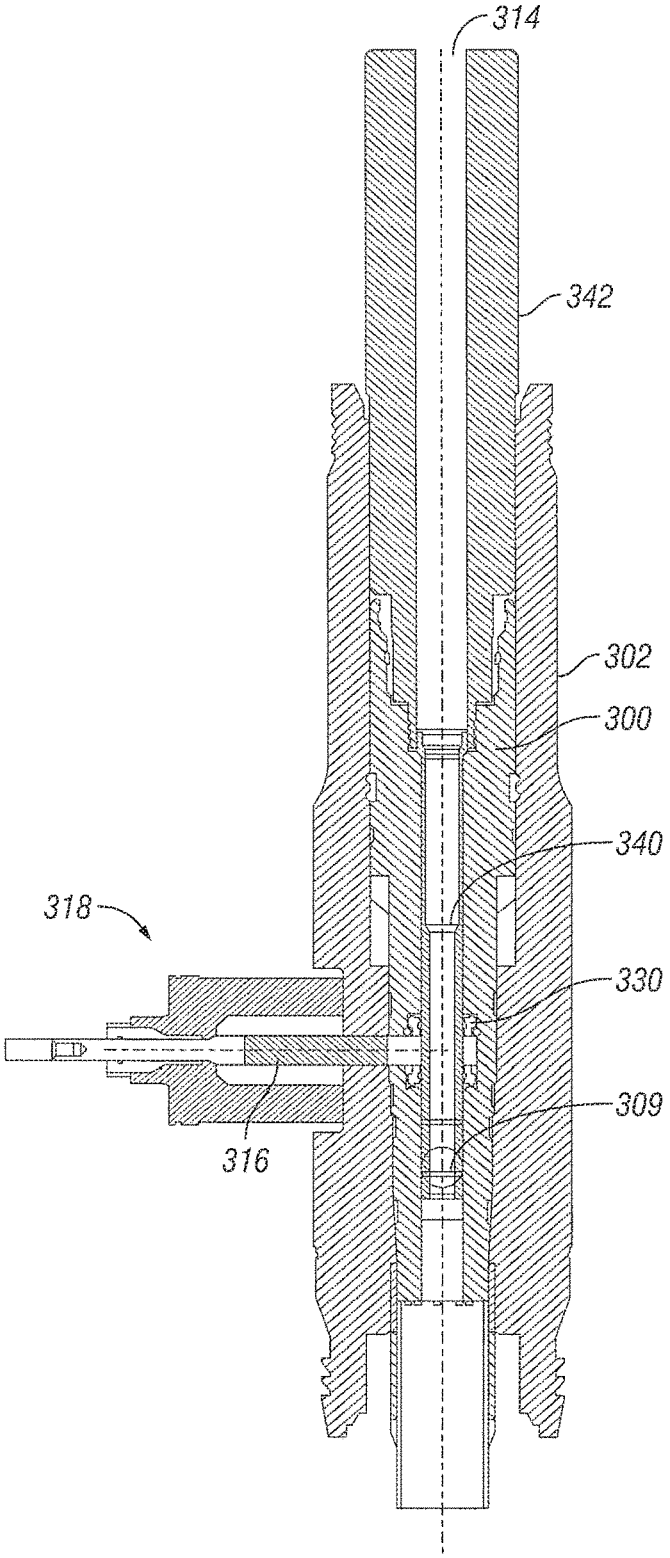
FIG. 7 depicts a cross-sectional view of a tubing hanger with a running tool and a protection sleeve in accordance with one or more embodiments of the present disclosure.

Referring now to FIG. 7, a cross-sectional view of a tubing hanger 300 with a protection sleeve 340 and a gate valve 318 is shown. Similar to above, the tubing hanger 300 is located within a tubing spool 302, and the gate valve 318 is shown in a retracted position. To avoid and/or prevent debris or other contaminants from getting lodged in the seats 330 when the gate 316 is retracted, a protection sleeve 340 may be installed using a running tool 342. Further, the protection sleeve 340 may be used to seal off and protect side outlet 309. In one or more embodiments, the protection sleeve 340 may be disposed within the vertical bore 314 until the gate valve 318 is to be actuated. When the protection sleeve 340 is removed, the gate 316 may be extended to seal off the vertical bore 314. In some embodiments, the gate 316 may remain extended to seal off the vertical bore 314 for a predetermined amount of time. For example, when well intervention or workover operations are warranted, the gate 316 may be retracted from the vertical bore 314 in order to provide access downhole. The running tool 342 with the protection sleeve 340 may be used during running the tubing hanger 300 down a subsea riser, for example, to avoid and/or prevent damage to the seats 330 and prevent debris getting lodged in the seats 330.

Figure 8:
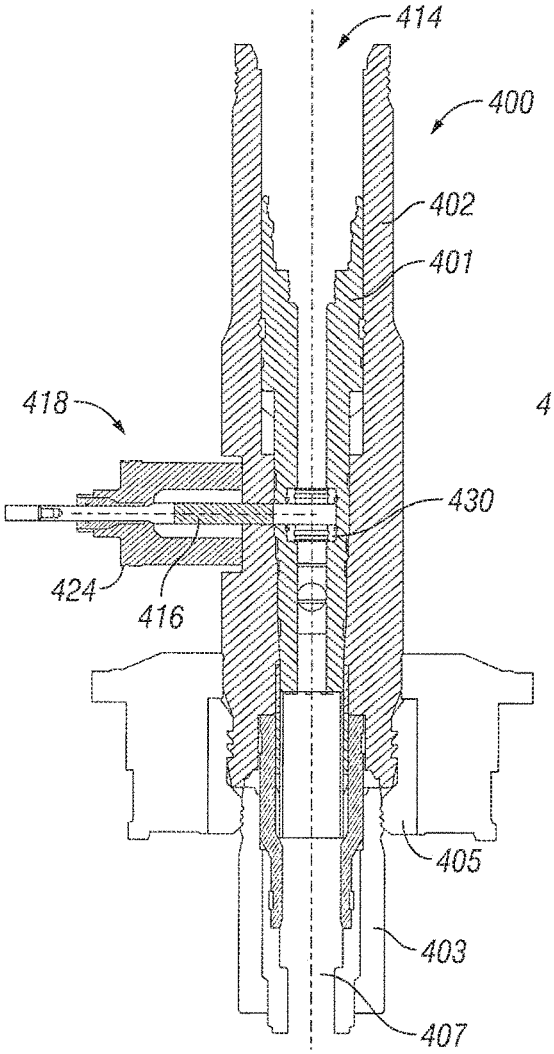
FIG. 8 depicts a cross-sectional view of a wellhead production assembly in accordance with one or more embodiments of the present disclosure.
Figure 9:
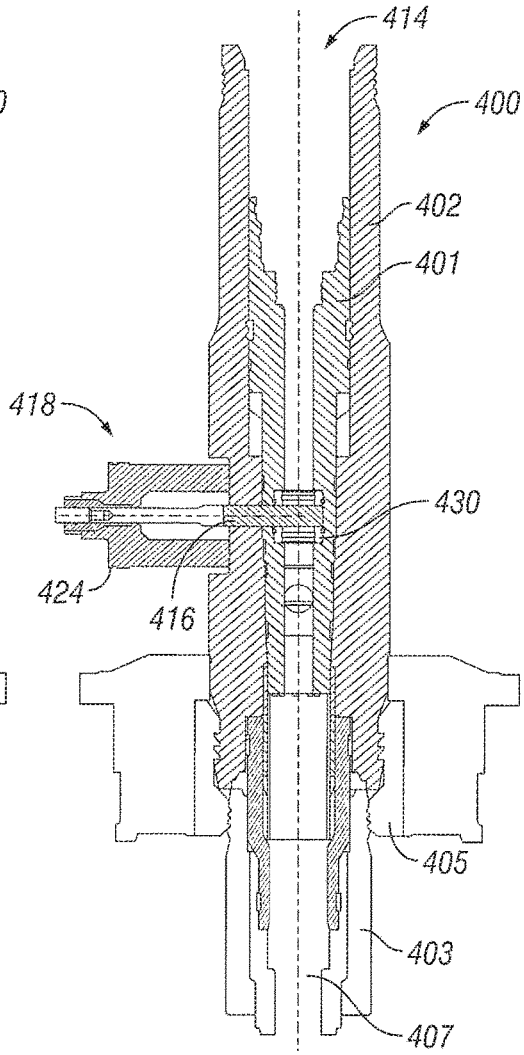
FIG. 9 depicts the wellhead production assembly of FIG. 8 with a gate valve in an extended position.

FIGS. 8 and 9 depict cross-sectional views of a wellhead assembly 400 and a gate valve 418 in retracted and extended positions in accordance with one or more embodiments of the present disclosure. The wellhead assembly 400 includes a tubing spool 402 coupled to a high pressure wellhead housing 403 using a connector 405. In FIGS. 8 and 9, similar to above, tubing hanger 401 is located within the tubing spool 402. A gate valve 418 having a gate 416 is shown retracted into bonnet 424 in FIG. 8, and is shown extended through the tubing spool 402 and the tubing hanger 401 into a bore 414 of the tubing hanger 400 in FIG. 9. Seats 430 may seal about the gate 416. In one or more embodiments, the gate 416 may extend through one or more of the high pressure wellhead housing 403, the tubing spool 402, and the tubing hanger 401 in order to close and/or seal off bore 414 of the tubing hanger 401. Further, the gate valve bonnet 424 is shown attached to the tubing spool 402, external to the tubing hanger 401. In some embodiments, the gate valve bonnet 424 may be attached to the high pressure wellhead housing 403 and the gate 416 may extend through a bore 407 in the high pressure wellhead housing 403.

In one or more embodiments, as above, the gate valve 416 may extend partially within bonnet 424 as well as partially within one or more of the high pressure wellhead housing 403, tubing spool 402, and tubing hanger 401, and the wellhead assembly 400 may include a tree, such as a horizontal tree, a vertical tree, a hybrid tree, and/or a modular tree, or other components known in the art. In addition, multiple gate valves 418 may be used in the high pressure wellhead housing assembly 403, each housed externally from the tubing hanger 401 and capable of extending into the bore 414 of the tubing hanger 401.

According to the present disclosure, the gate, housing, and one or more seats, among other components of a gate valve assembly or wellhead assembly may be composed of surface-hardened high strength corrosion resistant materials. Such a composition may prevent excessive corrosion and erosion of the gate and seats of the gate valves. The tubing hangers, tubing spools, and high pressure wellhead housings, among other components, as discussed herein, may be composed of a corrosion resistant material or inlayed, coated, or otherwise constructed to include a corrosion resistant material.

As disclosed herein, embodiments of the present disclosure allow for one or more valves to be housed externally from a tubing hanger. An externally housed gate valve may be used as a barrier element when operating with a horizontal tree, for example. The gate valve may be capable of closing a production and/or annulus bore and may be used instead of wireline plugs or tree cap. Trips to install and uninstall wireline plugs or tree caps may be reduced and/or eliminated, saving overall cost and time during operation.

In addition, a gate valve may be installed above or below a side outlet in a horizontal tree, for example, in place of a wireline plug. When the gate valve is installed below the side outlet, the gate valve may act as a primary vertical bore valve and may be used for emergency shut-offs. This also may eliminate the need for production wing valves and, during workover operations, the gate valve may be used to close the vertical bore. Eliminating the need for a production wing valve allows for a pressure barrier inside the vertical bore in a tree with the ability to retrieve the tubing hanger if needed. Although primarily discussed with respect to either a horizontal or a vertical tree, hybrid and/or modular trees that include a tubing hanger may also utilize one or more gate valves in order to provide one or more pressure barriers within the vertical bore This discussion is directed to various embodiments of the disclosure. The drawing figures are not necessarily to scale. Certain features of the embodiments may be shown exaggerated in scale or in somewhat schematic form, and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present invention has been described with respect to specific details, it is not intended that such details should be regarded as limitations on the scope of the invention, except to the extent that they are included in the accompanying claims.

What is claimed is:

1. A gate valve assembly for use with a tubing hanger with a vertical bore, the gate valve assembly comprising:
- a housing located externally to the tubing hanger and attachable to an exterior of a completion system component in which the tubing hanger is received;
- a gate at least partially locatable in the housing and configured to extend through the tubing hanger and into the tubing hanger vertical bore;
- an actuator rod connected with the gate;
- an actuator configured to extend and retract the gate; and
- a seat assembly comprising a seat and located within the tubing hanger, the seat assembly configured to seal against the gate when the gate is extended into the tubing hanger vertical bore.

2. The assembly of claim 1, wherein the tubing hanger is landable in a tree and the gate is configured to extend into the tree.

3. The assembly of claim 1, wherein the tubing hanger is landable in a tubing spool and the gate is configured to extend into the tubing spool.

4. The assembly of claim 1, wherein the gate is connected to the actuator rod with a T-slot connection.

5. The assembly of claim 1, wherein the seat assembly comprises more than one seat located within the tubing hanger.

6. The assembly of claim 5, wherein the gate is configured to engage with the seats when the gate is extended into the tubing hanger vertical bore.

7. The assembly of claim 5, wherein each seat comprises a poppet configured to hold the seat in place.

8. The assembly of claim 6, further comprising seat seals configured to seal the seats against the tubing hanger.

9. The assembly of claim 1, wherein the gate valve is configured to be actuated from a remote location.

10. The assembly of claim 1, further comprising a protection sleeve configured to land within the tubing hanger vertical bore.

11. The assembly of claim 1, further comprising a side outlet located within the tubing hanger vertical bore.

12. A wellhead assembly comprising:
- a high pressure wellhead housing;
- a tubing spool coupled to the high pressure wellhead housing;
- a tubing hanger configured to land in the tubing spool; and
- a gate valve assembly comprising:
  - a housing located externally to the tubing hanger and attached to the tubing spool;
  - a gate at least partially locatable in the housing and configured to extend through the tubing hanger and into a tubing hanger vertical bore;
  - an actuator rod connected with the gate;
  - an actuator configured to extend and retract the gate; and
  - a seat assembly comprising a seat and located within the tubing hanger, the seat assembly configured to seal against the gate when the gate is extended into the tubing hanger vertical bore.

13. The assembly of claim 12, further comprising a second gate valve comprising a housing located externally to the tubing hanger.

14. The assembly of claim 12, further comprising a protection sleeve configured to land within the tubing hanger vertical bore.

15. The assembly of claim 12, further comprising a side outlet located within the tubing hanger vertical bore.

16. The assembly of claim 12, wherein the gate is connected to the actuator rod with a T-slot connection.

17. The assembly of claim 12, further comprising at least one of a horizontal tree, a vertical tree, a hybrid tree, and a modular tree.

18. The assembly of claim 12, wherein the seat assembly comprises more than one seat located within the tubing hanger.

19. The assembly of claim 18, wherein the gate is configured to engage with the seats when the gate is extended into the tubing hanger vertical bore.

20. A completion method comprising:
- landing a tubing spool with a gate valve housing and a gate on a wellhead assembly;
- running a tubing hanger assembly with a running tool wherein the tubing hanger assembly comprises a seat assembly and a tubing hanger having a vertical bore;
- landing the tubing hanger assembly on the tubing spool with the gate valve housing located externally to the tubing hanger assembly;
- extending the gate through the tubing hanger and into the tubing hanger vertical bore via an actuator rod connected with the gate and an actuator; and
- sealing the seat assembly against the gate when the gate is extended into the tubing hanger vertical bore.

21. The completion method of claim 20, wherein the running tool comprises a protection sleeve.

22. The completion method of claim 20, wherein the actuator rod is connectable with the gate using a T-slot connection.

* * * * *